United States Patent [19]

Liu

[11] Patent Number: 4,694,132

[45] Date of Patent: Sep. 15, 1987

[54] MICROWAVE OVEN TURNTABLE WITH REMOVABLE TABLE TOP

[76] Inventor: Yiu C. Liu, 973 Shulman Ave., Santa Clara, Calif. 95050

[21] Appl. No.: 921,962

[22] Filed: Oct. 22, 1986

[51] Int. Cl.[4] ..... H05B 6/78

[52] U.S. Cl. ..... 219/10.55 F; 219/10.55 E; 126/338; 108/20; 99/443 R

[58] Field of Search ..... 219/10.55 F, 10.55 E; 126/338; 108/20, 139; 99/443 R

[56] References Cited

U.S. PATENT DOCUMENTS

| | | | |
|---|---|---|---|
| 557,344 | 3/1896 | Shaw | 108/20 |
| 4,036,151 | 7/1977 | Shin | 108/20 |
| 4,216,727 | 8/1980 | Cunningham | 108/20 |
| 4,239,009 | 12/1980 | Cunningham | 108/20 |
| 4,254,319 | 3/1981 | Beh et al. | 219/10.55 F |
| 4,330,696 | 5/1982 | Pomeroy et al. | 219/10.55 |
| 4,456,805 | 6/1984 | Jorgensen et al. | 219/10.55 |
| 4,501,945 | 2/1985 | Arabori et al. | 219/10.55 F |
| 4,504,715 | 3/1985 | Jorgensen et al. | 219/10.55 |
| 4,523,070 | 6/1985 | Jorgensen et al. | 219/10.55 |
| 4,590,351 | 5/1986 | Pomroy et al. | 219/10.55 |
| 4,591,682 | 5/1986 | Takeuji | 219/10.55 |

*Primary Examiner*—Philip H. Leung

[57] ABSTRACT

A microwave oven turntable having a removable table top driver at various points about its circumference. The turntable includes a base having a flat bottom and an upwardly extending cylindrical side wall. A central drive shaft is rotatably mounted to the base bottom to form a vertical axis of rotation. A spring provides rotational energy to the drive shaft. A dependent gear is coaxially mounted to the drive shaft and the dependent gear meshes with a gear train that governs the rate of drive shaft rotation so as to ensure a relatively constant rotational speed. The spring and gears are encased by a circular base cover member having a center aperture through which a portion of the drive shaft projects. A spider drive member is attached to the portion of the drive shaft projecting through the base cover member for rotation therewith. The spider drive member rests on a retainer ring having spherical balls and is additionally supported by freely rotatable wheels. Radial spider arms of the spider drive member frictionally contact the removable table top having a circular platform and cylindrical side walls. The circular platform has a lower surface containing a plurality of radially inwardly extending ribs that are concentrically spaced about the axis of rotation from the circumferential periphery. The ribs further extend downwardly along the cylindrical side wall of the table top to transfer rotational motion from the spider drive member to the table top. A braking mechanism is included to selectively render the gear train inoperative, thereby preventing table top rotation.

14 Claims, 6 Drawing Figures

MICROWAVE OVEN TURNTABLE WITH REMOVABLE TABLE TOP

TECHNICAL FIELD

The invention relates generally to microwave oven cooking and in particular to a portable turntable for rotating food cooking within a microwave oven.

BACKGROUND ART

Microwaves injected into the interior of a microwave oven rebound about the walls and door of the interior. As a result, the microwaves will sometimes interfere with one another to produce cold spots or will strengthen one another to produce hot spots. These cold spots and hot spots will vary depending upon the cookware inserted into the microwave oven.

Over a period of years advances have been made in eliminating this nonuniformity of microwave energy distribution. However, some nonuniformity still exists and, as a result, many microwave cook booklets suggest the desirability of stopping the oven periodically and physically rotating the food.

U.S. Pat. Nos. 4,036,151 to Shin and 4,591,682 to Takeuji disclose microwave ovens having a built-in turntable to effect uniform heating. Many conventional microwave ovens, however, do not include turntables. Therefore, to eliminate the inconvenience of manually rotating food, a need exists for a portable turntable that may be purchased as an accessory for a conventional microwave oven.

Portable turntables are known. Typically, the prior art portable turntable is a unitary apparatus that does not permit easy cleaning of internal workings. Yet these internal workings are sometimes invaded by food particles and make the turntable susceptible to breakdowns. Also, since the weight of a serving dish and the food within the serving dish may separate the table top from the point of drive, it is important to be able to easily inspect the turntable interior.

An object of the present invention is to provide a microwave oven turntable having an easy inspection and cleaning feature.

DISCLOSURE OF THE INVENTION

The above objects have been met by a portable microwave oven turntable that includes a removable table top driven at various points at or near its circumference. The turntable includes a base having a flat bottom and an upwardly extending cylindrical side wall. A central drive shaft is rotatably attached to the base bottom to form a vertical axis of rotation. A spring having a first end secured to the base and having a second end fixed to the drive shaft provides rotational drive to the drive shaft.

A dependent gear is mounted to the drive shaft, concentric the vertical axis. A gear train having a governor meshes with the dependent gear to ensure a relatively constant rotation speed. The spring and the gears are encased by a circular base cover member which is attached to the cylindrical side wall. A portion of the drive shaft, however, projects through a center aperture in the circular base cover member.

A spider drive member is attached to the portion of the drive shaft projecting through the base cover member for rotation therewith. The spider drive member rests on a retainer ring having spherical bearings which both facilitate and stabilize rotation of the spider drive member. Radial spider arms of the spider drive member frictionally contact a removable table top having a circular platform and a downwardly extending cylindrical side wall. The circular platform has a lower surface with a plurality of radially inwardly extending ribs that are concentrically spaced about the axis of rotation from the circumferential periphery. The ribs further extend downwardly along the cylindrical side wall of the table top. The ribs contact the edges of the spider arms to transfer rotational motion from the spider drive member to the table top. The combination of ribs contacting spider arms provide for an easily removable turntable table top so that the turntable may be cleaned or adjusted as necessary. Alternatively, other forms of "ribs" may be employed to abut the spider drive member so as to transfer rotational motion to the table top. Pins, for example, projecting downwardly from the circumference of the table top may be used to abut the spider arms.

An advantage of the present invention is that the removable table top is driven at a number of points about its circumference. Thus, an uneven distribution of weight on the table top is less likely to separate the table top from the drive means. Additionally, because the drive force is distributed, the turntable is able to handle a greater weight. A further advantage is that a removable turntable table top may be used as a food serving tray.

BEST MODE FOR CARRYING OUT THE INVENTION

Figure 1:
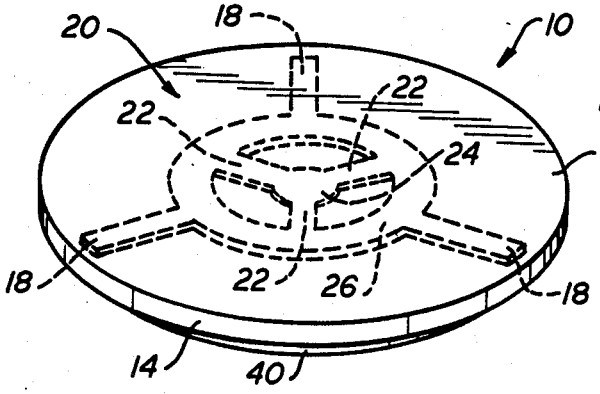
FIG. 1 is a top perspective view of a turntable in accord with the present invention.
Figure 2:
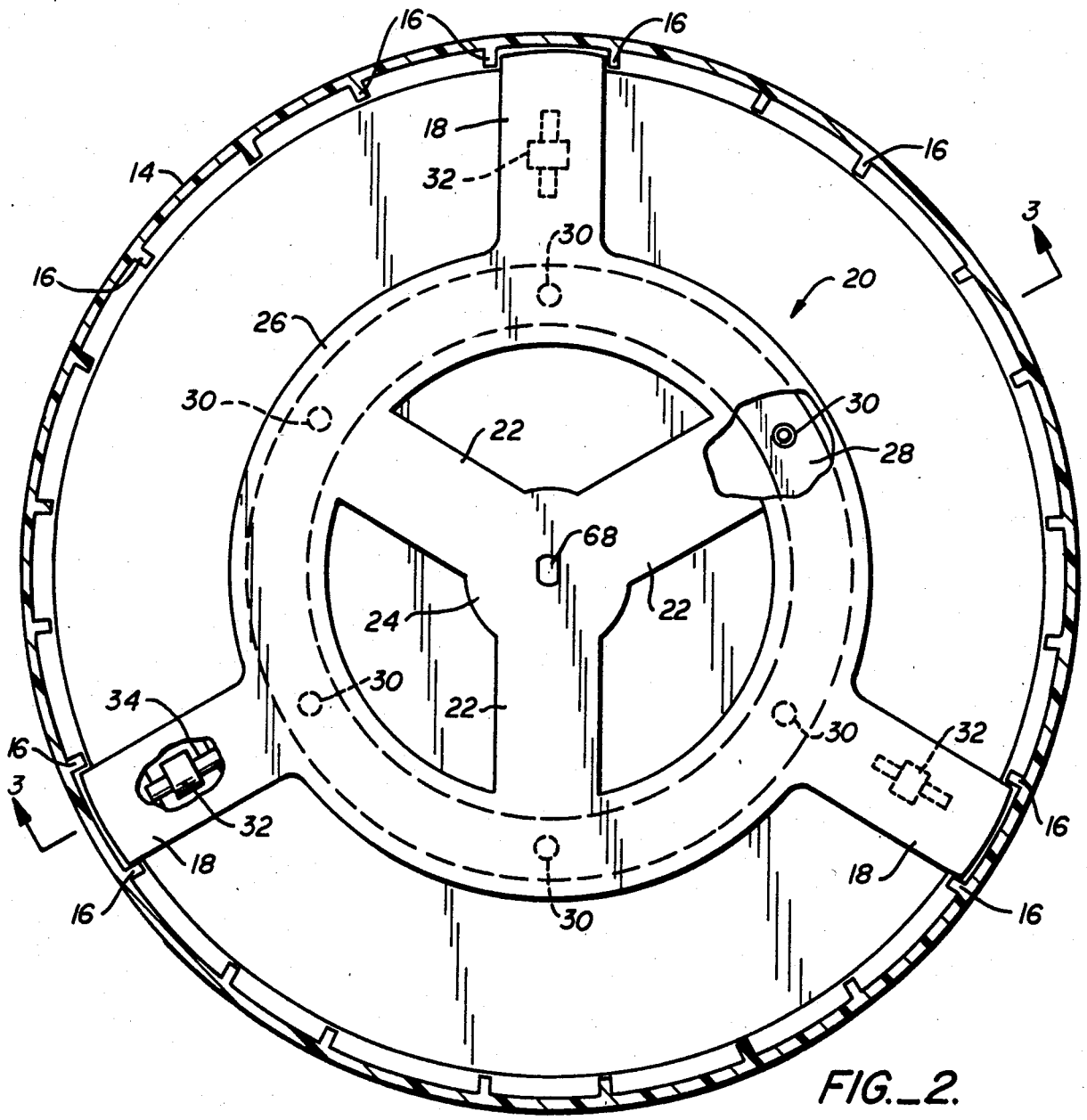
FIG. 2 is a top view of the turntable of FIG. 1.

With reference to FIGS. 1 and 2, a turntable 10 has a table top consisting of a circular platform 12 and a cylindrical side wall 14. The table top includes radially inwardly extending ribs 16 that project from the circumferential periphery of the table top to contact spider arms 18 of a spider drive member 20. Typically, the ribs 16 extend inwardly $\frac{1}{8}$ inch and downwardly $\frac{1}{4}$ inch along the side wall 14. The table top is made of a low-loss plastic material which is generally transparent to microwaves.

The spider drive member 20 has first radial arms 18 that contact ribs 16 when the spider drive member is caused to rotate. Thus, rotational drive is transferred to the table top platform 12 at a number of points about the circumference of the platform. The table top platform may be quickly and easily removed from the turntable 10 by lifting the platform from contact with the spider drive member 20.

The spider drive member 20 has a second arrangement of radial arms 22 originating from a spider hub 24 and reaching to the inner circumference of an annular portion 26. The first radial arms 18 originate at the outer circumference of the annular portion 26. A retainer ring 28 is disposed below the annular portion 26. The retainer ring 28 loosely secures a plurality of spherical bearings 30. The spider drive member 20 rides upon the spherical bearings 30. Thus, the retainer ring 26 adds stability to the midportion of the spider drive member which, in turn, stabilizes the table top platform 12. The contact of the spider drive member with the bearings of the retainer ring also facilitates rotation of the spider drive member. Additional support may be provided by rollers 32 or balls beneath the first spider arms 18. The drawings illustrate a roller 32 mounted on an axle 34.

The spider drive member 20 and the retainer ring 28 are made of material that is generally transparent to microwaves and has a low dielectric loss. Typically, the retainer ring is made of polypropylene. The spherical balls may be ordinary ball bearings. The bearings are sufficiently spaced that arcing will not occur.

Figure 3:
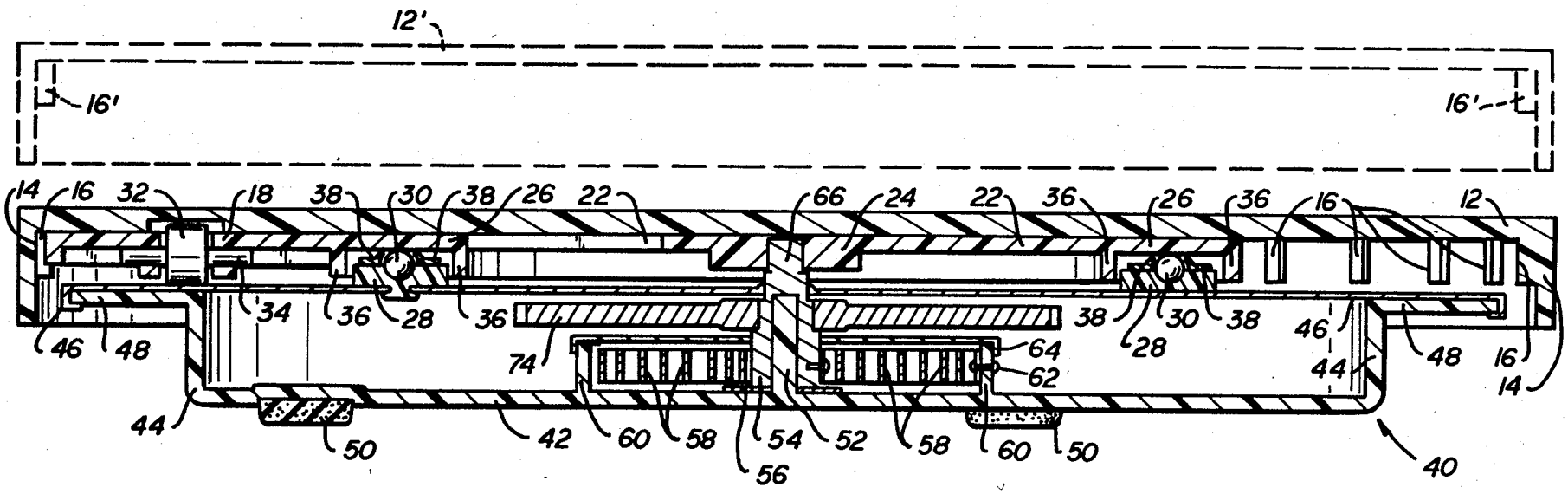
FIG. 3 is a side sectional view taken along lines 3—3 of FIG. 2.

Referring now to FIG. 3, the table top platform 12 rests atop the first spider arms 18, the second spider arms 22, the annular portion 26 and the hub 24 of the spider drive member. The ribs 16 of the table top contact the edges of the first spider arms 18. The ribs are caught by the spider arms when the spider arms are caused to rotate, thereby rotating the table top. The ribs extend vertically so that the table top may be lifted off of the supporting spider arms, as shown by dashed lines 12', for serving or cleaning.

The annular portion 26 of the spider drive member has vertical projections 36 which straddle the retainer ring 28. The annular portion is spaced apart from the retainer ring by the spherical bearings 30. Plastic annular keepers 38 encircle a portion of the spherical bearings 30 to loosely secure the bearings to the retainer ring. Optimally the retainer ring is a two piece assembly having a lower member that retains a second upper member. The upper member fits within the lower member and includes the spherical bearings. In this manner, the spherical bearings may be changed periodically.

The rotational drive for the table top platform 12 is provided from within a base assembly 40. The base assembly includes a circular bottom plate 42 and a cylindrical side wall 44. A base cover member 46 is supported atop the base assembly by the side wall 44. FIG. 3 shows the side wall having a horizontal portion 48 in contact with the base cover member 46. The horizontal portion 48 is not critical. The base cover member 46 is typically made of metal. The bottom plate 42 includes a plurality of feet 50.

A stud 52 projects from the bottom plate 42. A drive shaft 54 is rotatably fitted over the stud 52 with a washer 56 spacing the drive shaft apart from the bottom plate. A coil spring 58 has a first end fixed to a spring housing 60. The coil spring may be secured to the housing by a screw 62 or any other means of securely attaching a spring. The coil spring 58 has a second end which is similarly secured to the drive shaft 54. When the spring is tightly wound the drive shaft will be urged to rotate about a vertical axis passing through the stud 52. A spring cover 64 shields the coil spring 58 from microwaves.

Referring to FIGS. 2 and 3, the drive shaft 54 has a portion which projects through the base cover member 46. The uppermost portion 66 of the drive shaft has opposed parallel sides which match the configuration of a center aperture 68 in the drive spider member 20. Thus, when the drive shaft 54 is caused to rotate by the coil spring 58 the spider drive member and the table top platform 12 will rotate as well.

Figure 4:
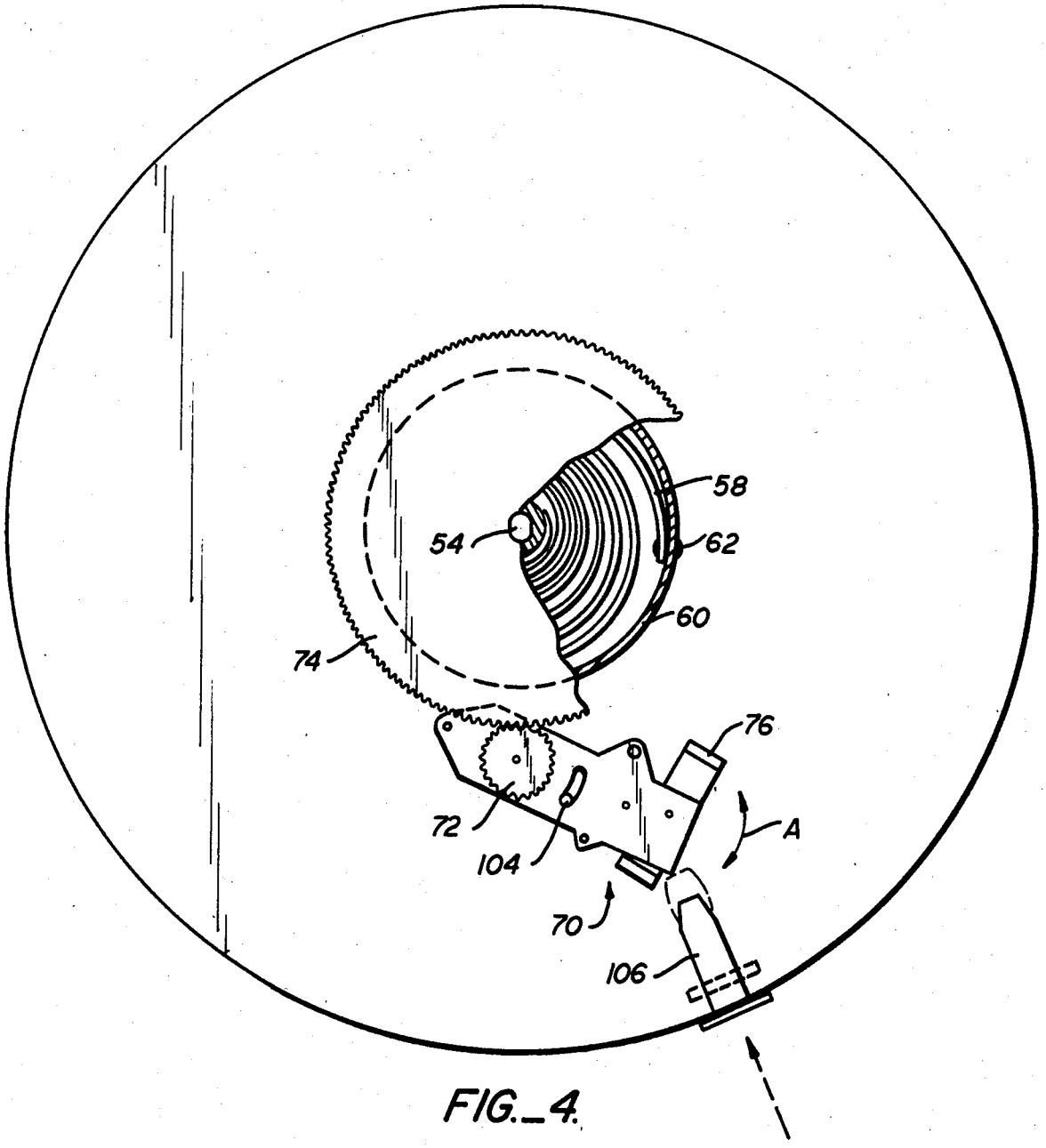
FIG. 4 is a top view of the base assembly of FIG. 1.
Figure 5:
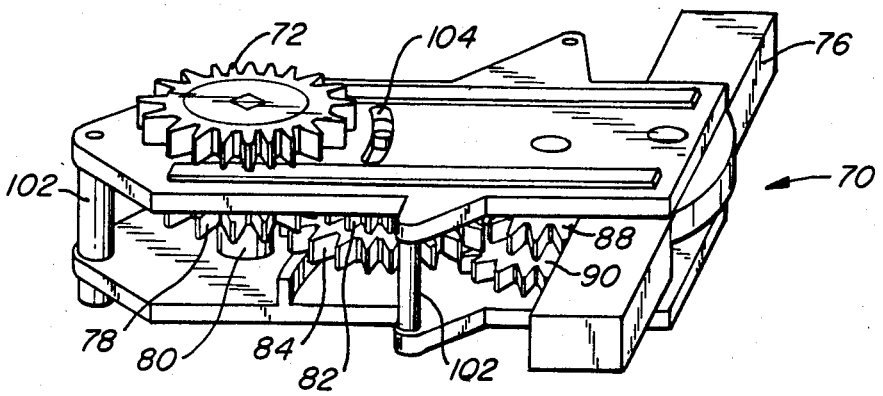
FIG. 5 is an perspective view of the gear train within the apparatus of FIG. 4.
Figure 5A:
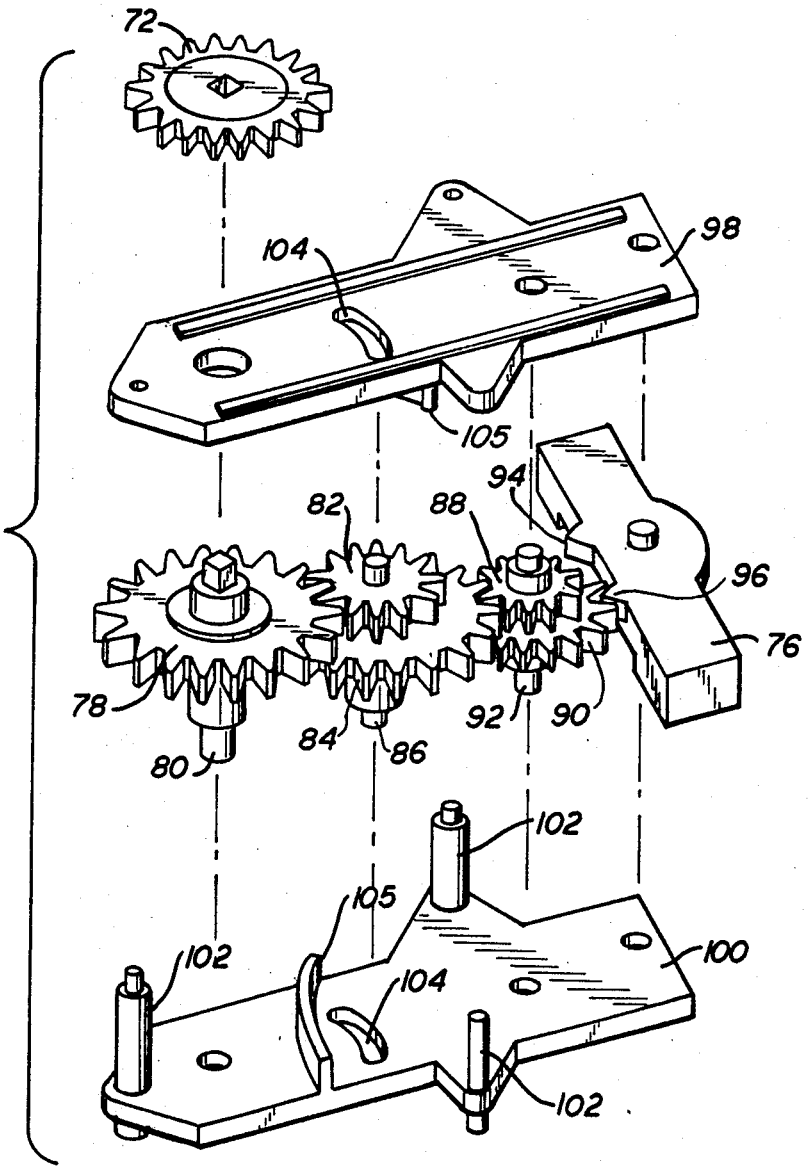
FIG. 5A is an exploded view of the gear train of FIG. 5.

A coil spring which is tightly wound will unwind quickly when released unless a mechanism governs the speed of the unwinding action. That is, unless a mechanism is provided to govern the speed at which coil spring 58 will unwind, the table top platform 12 will spin out of control when the coil spring is wound and then released. leased. Referring to FIGS. 4, 5 and 5A, the table top is prevented from uncontrollably spinning by a gear train assembly 70. The gear train assembly includes an input gear 72 that meshes with a dependent gear 74. Since the dependent gear 74 is coaxially fixed to the drive shaft 54, the drive shaft will rotate only as quickly as the gear train assembly 70 permits.

The gear train assembly is a gear step-up transmission mechanism. A governor 76 ultimately determines the rate of input gear rotation. In a gear step-up transmission the speed of input gear 72 rotation is multiplied by each succeeding gear. The input gear is mounted coaxially with an escapement gear 78 on shaft 80. The escapement gear meshes with an idler gear 82 that is coaxial with an intermediate gear 84 on shaft 86. The intermediate gear 84 then meshes with an idler gear 88 that is coaxial with a ratchet gear 90 on shaft 92.

The governor 76 has two pawls 94 and 96 meshing with the ratchet gear 90 at different points. A first pawl 94 will completely mesh with a tooth of the ratchet gear only when the second pawl 96 is freed from the ratchet gear. The second pawl 96 will completely mesh only when the first pawl 94 is freed from the ratchet gear. Thus, the governor will oscillate back and forth as the ratchet gear 90 rotates and the permissible speed of gear rotation is determined by the vibrational speed of the governor 76. This oscillation or nutation is shown by arrow A.

Shafts 80, 86 and 92 are held between a pair of plates 98 and 100. The plates are spaced apart by posts 102. Plates 98 and 100 each have an elongated slot 104 through which shaft 86 is slideably fit. When the input gear 72 is caused to be rotated in a counterclockwise direction, the escapement gear 78 forces the shaft 86 to one end of the slot 104. In this position the intermediate gear 84 meshes with the ratchet gear 90. If however, the input gear is rotated in a clockwise direction, as when the coil spring 58 is being wound, the shaft 86 is forced to the opposite end of the slot 104 whereupon the intermediate gear 84 will not mesh with the ratchet gear. This construction prevents the governor 76 from impeding the speed at which the coil spring can be wound. Ridges 105 ensure that the movable idler gear 82 remains on the same plane as the escapement gear 78.

A braking mechanism 106 is provided for locking the governor 76. In this manner the table top may be prevented from rotating until rotation is desired. FIG. 4 shows the braking mechanism 106 in a position to restrict movement of the governor, but this is not critical. Alternatively, the braking mechanism may lock the intermediate gear 84 into a position that prevents rotation.

In operation, energy for rotation is stored in the coil spring 58 by twisting the table top 12 with respect to the base 40. Rotation of the table top in a counterclockwise direction wraps the coil spring about the drive shaft 54. Upon release of the table top the coil spring will urge the drive shaft in a clockwise direction. The drive shaft and the dependent gear 74 will begin to rotate but the speed of rotation will be controlled by the nutations of the governor 76, which is part of the gear train 70. A braking mechanism is provided to prevent rotation entirely.

Movement of the drive shaft 54 is transmitted to the spider drive member 20, which is supported firstly at its center and secondly at the point of contact with the spherical bearings 30. Additionally, the first spider arms 18 may be supported by wheels 32.

Rotational movement of the spider drive member 20 is transferred to the table top platform 12 by the contact of the spider drive member against radially inwardly extending ribs 16 projecting along the lower surface of the platform.

Thus, rotational transfer takes place at various points about the circumferential periphery of the table top. The ribs 16 are vertical, allowing the table top to be lifted off of the supporting spider arms for serving or cleaning.

While the preferred embodiment contains ribs that extend downwardly along the side wall 14, it is understood that other ribs may be utilized as an alternative. For example, pins projecting downwardly from the table top at or near the circumference of the table top, so as to abut the spider arms, may be employed to transfer rotational motion to the table top.

The force required to wind the microwave oven turntable is less than 5 lbs. of torque. Because of the support provided by the spherical bearings 30 and wheels 32, the turntable is able to operate with a load in excess of 30 lbs. A turntable without wheels 32 is able to rotate a load of approximately 25 lbs. The rate of rotation is about one revolution per minute and rotation will occur for approximately twenty minutes but these two factors may be varied by varying the gear ratios of the gear train 70, or by changing the make-up of the coil spring 58.

I claim:

1. A portable microwave oven turntable comprising, a base having a horizontal bottom and uprightly extending sides to form a base interior, a coil spring disposed within said base interior, a central drive shaft rotatably attached to said base to form a vertical axis of rotation, said coil spring disposed to turn said drive shaft, means for governing the rotational speed of said central drive shaft, a circular base cover member connected to said base, said base cover member having an inner circumference defining a center aperture, said central drive shaft having an upper portion projecting through said center aperture, a spider drive member concentrically positioned atop said base cover member, said spider drive member mounted to said upper portion of the central drive shaft, said spider drive member having a plurality of radial spider arms, said spider arms having coplanar upper surfaces, and a circular table top removably rested atop said spider drive member, said table top having a substantially planar platform and a downwardly extending cylindrical side wall and having a plurality of projecting members, each projecting member extending downwardly from a surface of said planar platform adjoining said spider drive member, a plurality of said projecting members in rotational transfer engagement with said spider arms.

2. The microwave oven turntable of claim 1 further comprising a retainer ring concentrically disposed atop said base cover, said retainer ring having loosely held spherical bearings in supporting contact with said spider drive member.

3. The microwave oven turntable of claim 2 wherein said plurality of radial arms of the spider drive member are first radial arms, said spider drive member further having a plurality of second radial arms and having an annular portion, said second radial arms extending from an inner circumference of said annular portion and toward said vertical axis, said first radial arms extending from an outer circumference of said annular portion and away from said vertical axis, said annular portion of the spider drive member having downwardly extending projections to straddle said retainer ring.

4. The microwave oven turntable of claim 3 wherein said first radial arms are supported by freely rotatable wheels.

5. The microwave oven turntable of claim 1 wherein said means for governing the rotational speed of said central drive shaft includes a dependent gear coaxially mounted to said drive shaft and includes a gear train having an oscillating governor.

6. The microwave oven turntable of claim 1 wherein said plurality of projecting members are ribs and said ribs each extend vertically along said cylindrical side walls of said table top and radially inwardly along said surface of the platform adjoining the spider drive member.

7. The microwave oven turntable of claim 1 further comprising a braking mechanism for preventing rotation of said drive shaft.

8. A portable microwave oven turntable comprising, a base assembly having a planar bottom and upwardly extending base sides and having a circular base cover member attached to said base sides to form a base cavity, said base assembly further having a drive shaft rotatable about a vertical axis and having a spring means for rotating said drive shaft, said spring means disposed within said base cavity, said drive shaft having a portion projecting through the center of said circular cover member from said body cavity, a spider drive member attached to said portion of said drive shaft projecting through said base cover member for rotating about said vertical axis, said spider drive member having a plurality of radial arms, said radial arms having coplanar upper surfaces, each radial arm having opposed side edges, and a circular table top having a plurality of projecting members releasably mating with said side edges of the spider drive member for rotation therewith, said table top having downwardly depending side walls, said projecting members extending radially inwardly from the periphery of said circular table top adjacent said side walls, said projecting members further extending downwardly on said downwardly depending side wall.

9. The microwave oven turntable of claim 8 further comprising a retainer ring atop said base cover member, said retainer ring having a plurality of spaced apart loosely held spherical bearings, said spherical bearings supporting said spider drive member.

10. The microwave oven turntable of claim 9 wherein said plurality of radial arms of the spider drive member are first radial arms, said spider drive member further having a plurality of second radial arms and having an annular portion, said second radial arms extending from an inner circumference of said annular portion and toward said vertical axis, said first radial arms extending from an outer circumference of said annular portion and away from said vertical axis, said annular portion of the spider drive member having downwardly extending projections to straddle said retainer ring.

11. The microwave oven turntable of claim 8 further comprising gear train means for governing the speed of rotation of the drive shaft.

12. The microwave oven turntable of claim 11 further comprising a braking mechanism, said braking mechanism selectively locking operation of said gear train, thereby preventing drive shaft rotation.

13. The microwave oven turntable of claim 8 wherein said spider arms each have a freely rotatable wheel in contact with said base cover member.

14. The microwave oven turntable of claim 8 wherein said projecting members are ribs.

* * * * *